US007062194B2

(12) United States Patent
Yanagida et al.

(10) Patent No.: US 7,062,194 B2
(45) Date of Patent: Jun. 13, 2006

(54) CHARGING DEVICE, AND PROCESS CARTRIDGE AND IMAGE FORMING APPARATUS INCLUDING THE CHARGING DEVICE

(75) Inventors: Masato Yanagida, Meguro-ku (JP); Hiroyuki Nagashima, Yokohama (JP); Naohiro Kumagai, Kawasaki (JP); Toshio Koike, Kawasaki (JP); Atsushi Sampe, Yokohama (JP); Masanori Kawasumi, Yokohama (JP); Eisaku Murakami, Suginami-ku (JP); Takeshi Uchitani, Kamakura (JP); Masami Tomita, Numazu (JP); Takeshi Shintani, Kawasaki (JP); Tsutomu Yamakami, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 128 days.

(21) Appl. No.: 10/843,574

(22) Filed: May 12, 2004

(65) Prior Publication Data

US 2004/0228648 A1 Nov. 18, 2004

(30) Foreign Application Priority Data

May 12, 2003 (JP) ..... 2003-132990
Feb. 2, 2004 (JP) ..... 2004-024958

(51) Int. Cl.
*G03G 15/02* (2006.01)
*G03G 21/00* (2006.01)

(52) U.S. Cl. ..... 399/100; 399/357; 430/110.3; 430/110.4

(58) Field of Classification Search ..... 399/100, 399/101, 357, 343, 326, 327; 430/125
See application file for complete search history.

(56) References Cited

U.S. PATENT DOCUMENTS

| | | | | |
|---|---|---|---|---|
| 4,533,235 | A | 8/1985 | Uchida | 399/357 |
| 5,633,701 | A | 5/1997 | Yoshida | 399/175 |
| 5,799,229 | A * | 8/1998 | Yokoyama et al. | 399/100 |
| 6,389,255 | B1 * | 5/2002 | Sawada et al. | 399/176 |
| 6,503,615 | B1 * | 1/2003 | Horii et al. | 428/316.6 |
| 6,660,443 | B1 | 12/2003 | Sugiyama et al. | 430/108.4 |
| 6,682,866 | B1 | 1/2004 | Sugiyama et al. | 430/108.1 |
| 6,701,105 | B1 * | 3/2004 | Funabashi | 399/100 |
| 6,740,460 | B1 | 5/2004 | Tomita et al. | 430/109.4 |
| 2003/0039483 | A1 | 2/2003 | Funabashi | 399/100 |
| 2003/0113648 | A1 * | 6/2003 | Tomita et al. | 430/110.4 X |
| 2003/0152859 | A1 * | 8/2003 | Emoto et al. | 430/110.3 X |
| 2004/0213597 | A1 * | 10/2004 | Yanagida et al. | 399/100 |

FOREIGN PATENT DOCUMENTS

| | | | |
|---|---|---|---|
| JP | 5-297690 | | 11/1993 |
| JP | 11-128137 A | * | 5/1999 |
| JP | 2002-221883 | | 8/2002 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A charging device including a charging roller having a metallic cylinder with an elastic layer disposed thereon, and a cleaner for cleaning the surface of the charging roller. The cleaner includes a driving shaft and a cleaning roller rotatably mounted on the driving shaft. The cleaning roller is made of a non-cellular foam resin having a density of from 5 to 15 kg/m$^3$ and a tensile strength of from 1.2 to 2.2 kg/cm$^2$.

17 Claims, 8 Drawing Sheets

CHARGING DEVICE, AND PROCESS CARTRIDGE AND IMAGE FORMING APPARATUS INCLUDING THE CHARGING DEVICE

This document claims priority and contains subject matter related to Japanese Patent Applications Nos. 2003-132990 and 2004-024958, filed on May 12, 2003 and on Feb. 2, 2004 respectively incorporated herein by reference.

BACKGROUND OF THE INVENTION

1. Field of the Invention

The present invention relates to a charging device which charges an image bearing member with a charging roller in an electrophotographic image forming apparatus and which has a cleaner cleaning the charging roller. In addition, the present invention also relates to an image forming apparatus, such as copiers and printers which use the charging device, and a process cartridge using the charging device.

2. Discussion of the Background

In conventional electrophotographic image forming apparatus, an image is typically formed by the following method:

(1) an image bearing member, such as photoreceptors, is charged with a charge having a predetermined polarity (i.e., charging process);

(2) the image bearing member is exposed to light to form a latent electrostatic image thereon (i.e., light irradiation process);

(3) the latent electrostatic image is developed with a toner having a charge with the same polarity as that of the latent electrostatic image to form a toner image (i.e., developing process);

(4) the toner image is transferred to a receiving material such as papers (i.e., transferring process); and (5) the toner image is fixed on the receiving material upon application of heat and pressure thereto to form a hard copy (i.e., fixing process).

Even after the transfer process, a small amount of toner particles remains on the surface of the image bearing member. Therefore, the surface of the image bearing member is typically cleaned by a cleaner, such as cleaning blades and cleaning brushes, before the next charging process.

Recently, either contact charging methods in which a voltage is applied to an image bearing member by an electroconductive charging roller in contact with the image bearing member or short-range charging methods in which a voltage is applied to an image bearing member by an electroconductive charging roller set in the vicinity of the image bearing member, are typically used for the charging process. This is because these charging methods have advantages, such that the amount of ozone generated due to charger discharging can be controlled and the power consumption of the charger can be reduced.

However, when residual toner particles are insufficiently removed, a problem occurs in that, when the remaining toner particles contact with or are close to the charging roller, the remaining toner particles may adhere thereto. This is because the remaining toner particles typically include toner particles which have a charge with a polarity opposite to the polarity of the charging roller, thus the reversely-charged toner particles are attracted to the charging roller, resulting in adhesion of the toner particles to the surface of the charging roller. In addition, dust such as paper dust generated by receiving papers, which has a charge with a polarity opposite to that of the charging roller can also adhere to the charging roller.

Recently a need has existed for an electrophotographic image forming apparatus capable of producing high quality and high definition images. Therefore, spherical toners, having a relatively small particle diameter, are typically used to form a toner image because they can be densely adhered to a latent electrostatic image. However, one of the drawbacks of such a small spherical toner is that a cleaning blade cannot properly scrape the toner particles because often they pass through the nip between the image bearing member and the cleaning blade, resulting in the occurrence of insufficient cleaning of the surface of the image bearing member (namely, the charging roller is contaminated with toner particles). Therefore, it is necessary to clean the surface of the charging roller to prevent the occurrence of various undesirable problems.

Specific examples of such cleaning members for use in such a charging roller include sponge materials, such as polyurethane and polyethylene foams disclosed in unexamined published Japanese patent application No. 5-297690, and brush rollers disclosed in unexamined published Japanese patent application No. 2002-221883. Toners remaining on the surface of a charging roller are removed when such cleaning members are brought into contact with and abrades the surface of the charging roller. The removed matters are collected in pores inside the sponge material or between brush fibers on the brush roller. However, the amount of the unwanted toner that can be stored in such members is limited. Therefore, maintaining good cleaning performance for a long period of time remains an unresolved issue. For example, in the case of a process cartridge including a charging roller, the charging roller needs to have a useful life as long as those of other members constituting the process cartridges, each of which has a relatively long life. Therefore, a cleaning device having such a brush roller is not suitable for such process cartridges.

In addition, it is necessary for the cleaning device to remove foreign materials such as paper dust, which adhere to the charging roller.

Because of these reasons, the need exists for a long-life charging device having a cleaner which can efficiently clean materials electrostatically adhered to the surface of a charging roller.

SUMMARY OF THE INVENTION

Accordingly, an object of the present invention is to provide a long-life charging device with a cleaner which can efficiently clean materials electrostatically adhered to the surface of a charging roller.

Another object of the present invention is to provide a process cartridge and an image forming apparatus, which can produce high quality and high definition images over a long period of time.

Briefly, these objects and other objects of the present invention as hereinafter will become more readily apparent can be attained by a charging device including a charging roller having a metallic cylinder with an elastic layer disposed thereon, and a cleaner configured to clean the surface of the charging roller. The cleaner includes a driving shaft and a cleaning roller rotatably mounted on the driving shaft. In addition, the cleaning roller is made of a non-cellular foam resin having a tensile strength of from 1.2 to 2.2 $kg/cm^2$.

It is preferred that the foam resin mentioned above have a density of from 5 to 15 $kg/m^3$.

It is preferred that the foam resin mentioned above have an expansion rate of from 20 to 40%.

It is also preferred that the cleaning roller mentioned above be made of a melamine foam resin.

It is also preferred that the cleaning roller mentioned above be rotatably contacted with the charging roller such that the cleaning roller interlockingly rotates together with the charging roller.

The cleaning roller mentioned above preferably has an oscillating unit configured to oscillate the cleaning roller along the longitudinal direction thereof.

The cleaning roller can have a one-way clutch on the shaft thereof to slightly change the contact face of the cleaning roller with the charging roller.

As another aspect of the present invention, a cleaner for cleaning a surface of a charging roller is provided which includes a roller having a driving shaft and a cleaning roller rotatably mounted on the driving shaft, and made of a non-cellular foam resin having a tensile strength ranging from 1.2 to 2.2 kg/cm$^3$.

It is preferred that that the non-cellular foam resin constituting the cleaning roller included in the cleaner mentioned above have a density ranging from 5 to 15 kg/m$^3$.

Yet in another aspect of the present invention, a process cartridge is provided which can be detachably attached to an image forming apparatus and which includes:

at least an image bearing member configured to bear a latent electrostatic image; and the charging device firstly mentioned above configured to charge the image bearing member.

It is preferred that the foam resin contained in the charging device included in the process cartridge mentioned above have a density ranging from 5 to 15 kg/m$^3$.

Yet in another aspect of the present invention, an image forming apparatus is provided which includes:

an image bearing member;

the charging device firstly mentioned above configured to charge the image bearing member;

a light irradiator configured to irradiate the charged image bearing member with light to form a latent electrostatic image on the image bearing member;

a developing device configured to develop the electrostatic latent image with a developer including a toner to form a toner image on the image bearing member;

a transferring device configured to transfer the toner image onto a receiving material; and a fixing device configured to fix the toner image on the receiving material.

It is preferred that the non-cellular foam resin constituting the cleaning roller included in the cleaner contained in the charging device of the image forming apparatus mentioned above have a density ranging from 5 to 15 kg/m$^3$.

The toner preferably has a volume average particle diameter (Dv) of from 3 to 8 μm, and a ratio (Dv/Dn) of the volume average particle diameter (Dv) to a number average particle diameter (Dn) of from 1.00 to 1.40.

In addition, each of the form factors SF-1 and SF-2 of the toner is preferably greater than 100 and not greater than 180.

The toner is preferably prepared by a method including:

dispersing or dissolving toner constituents including at least a polyester prepolymer having a functional group having a nitrogen atom, another polyester resin, a colorant, and a release agent in an organic solvent to prepare a toner constituent liquid; and dispersing the toner constituent liquid in an aqueous medium including a compound capable of reacting the functional group of the polyester prepolymer to crosslink and/or elongate the polyester prepolymer and to form toner particles in the aqueous medium.

It is also preferred that the toner have a spherical form and satisfy the following relationships:

$$0.5 \leqq r2/r1 \leqq 1.0; \text{ and}$$

$$0.7 \leqq r3/r2 \leqq 1.0,$$

where r1 represents a major-axis particle diameter, r2 represents a minor-axis particle diameter, and r3 represents a thickness of the toner, and r3≦r2≦r1. In this case, it has been determined that 100 toner particles are sufficient to determine the ratios r2/r1 and r3/r2.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be explained with reference to drawings.

Figure 1:
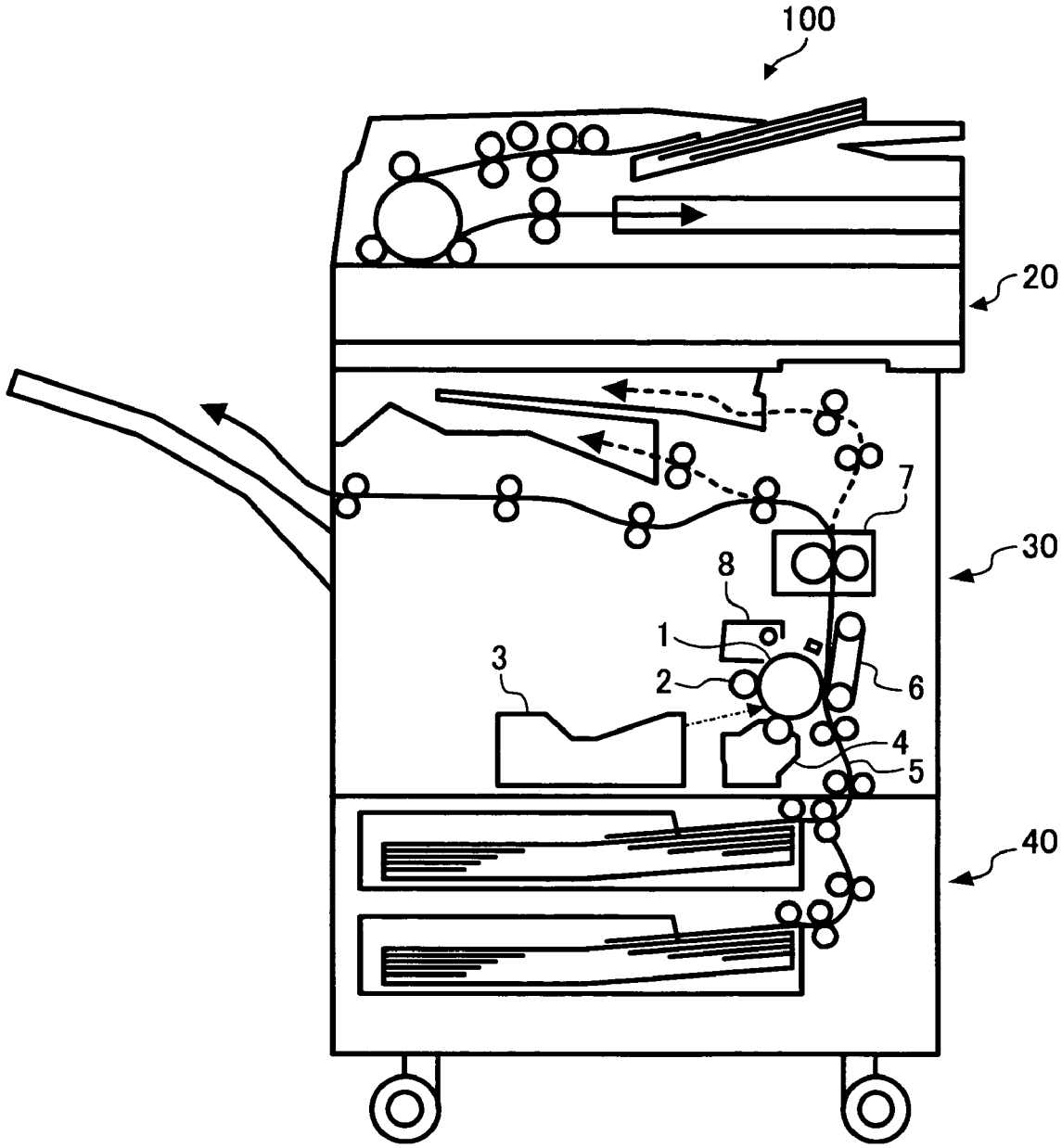
FIG. 1 is a schematic view illustrating the cross section of an image forming apparatus having an embodiment of the charging device of the present invention.
Figure 2:
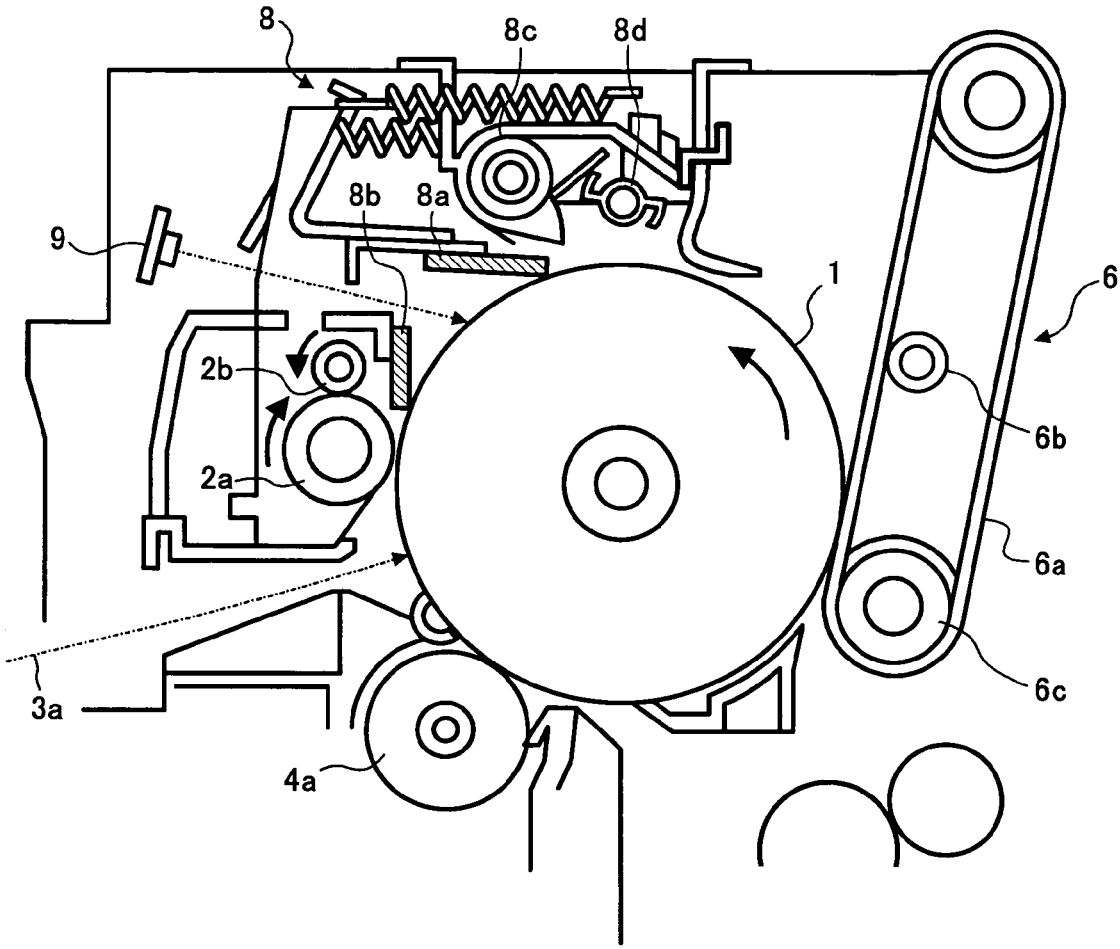
FIG. 2 is an enlarged view of the main portion of the image forming apparatus illustrated in FIG. 1.
Figure 3:
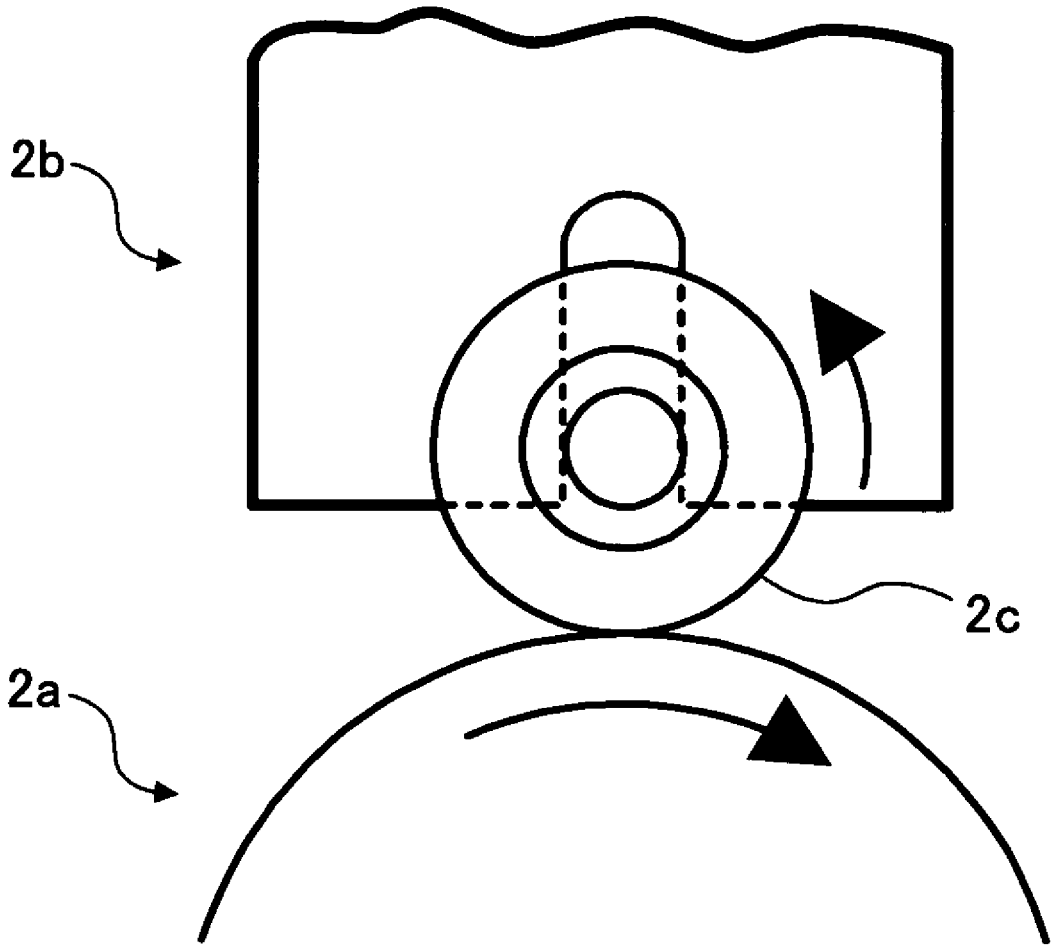
FIG. 3 is a schematic view illustrating an embodiment of the cleaner of the charging device of the present invention.

FIG. 1 is a schematic view illustrating the cross section of an image forming apparatus having an embodiment of the charging device of the present invention. FIG. 2 is an enlarged view of the main portion of the image forming apparatus illustrated in FIG. 1. An image forming apparatus (e.g., an electrophotographic copier) 100 includes a scanner unit 20 which reads the image of an original, an image forming unit 30 which reproduces the read image on a receiving material 5, and a paper feeding unit 40 which timely feeds the receiving material 5 to the image forming unit 30. The image forming unit 30 includes a photoreceptor 1, serving as an image bearing member, and a charging device 2, a light irradiator 3, a developing device 4, a transferring device 6, a fixing device 7, and a cleaning device 8 are arranged in the vicinity of the photoreceptor 1. Numeral 9 (illustrated in FIG. 2) denotes a discharger configured to irradiate the photoreceptor 1 with light to discharge charges remaining on the photoreceptor 1.

The photoreceptor 1 includes a photoconductive material such as amorphous metals, e.g., amorphous silicon and amorphous selenium; and organic compounds such as bisazo pigments and phthalocyanine pigments. In view of environmental protection and post-treatment of the photoreceptor, the organic compounds are preferably used.

As illustrated in FIG. 2, the charging device 2 has a charging roller 2*a* having a metallic cylinder with an elastic layer formed on its peripheral surface, a cleaner 2*b* and a power source (not shown) connected with the charging roller 2*a*. The power source applies a high voltage to the charging roller 2*a* to form a predetermined high electric field at a region where the charging roller 2*a* faces the photoreceptor 1. As a result, corona discharging occurs at the charging portion, and thereby the surface of the photoreceptor 1 is uniformly charged.

The cleaner 2*b* has a cleaning roller 2*c* configured to clean the surface of the charging roller 2*a*. The cleaner 2*b* will be explained below in detail.

The light irradiator 3 converts the data, which are read by a scanner in the scanner unit 20 or sent from an external device such as personal computers, to image data. The light irradiator 3 irradiates the surface of the photoreceptor 1 with a laser light 3*a* via an optical system (not shown) including a polygon mirror, mirrors, lens, etc.

The developing device 4 has a developer containing member 4*a*, including a toner, to supply the developer to the photoreceptor 1, a toner supplying compartment, a developer regulator configured to control the thickness of the developer layer formed on the developer containing member 4*a* and other members. The developer containing member 4*a*, is arranged in the vicinity of the photoreceptor 1 while a small gap is formed therebetween.

The developer containing member 4*a* includes a rotatably supported cylindrical developer containing member and a magnetic roller coaxially fixed inside the cylindrical developer containing member. The developer containing member 4*a* transports the developer on its peripheral surface using a magnetic force generated by the magnetic roller. The developer containing member 4*a* is electroconductive and is made of a nonmagnetic material. In addition, a power source is connected with the developer containing member 4*a* to apply a developing bias thereto. Namely, a voltage is applied to the developer containing member 4*a* to form an electric field between the photoreceptor 1 and the developer containing member 4*a*.

The transfer device 6 includes a transfer belt 6*a*, a transfer bias roller 6*b*, and a tension roller 6*c*. The transfer bias roller 6*b* has a metallic cylinder and an elastic layer formed on the metallic cylinder. When a toner image is transferred from the photoreceptor 1 to the receiving material 5, a pressure is applied to the transfer bias roller 6*b* to press the receiving material 5 to the photoreceptor 1.

The transfer belt 6*a* is a seamless belt made of a material having a high heat resistance, such as polyimide films. A fluorine-containing resin layer can be formed on the outermost surface of the transfer belt 6*a*. In addition, a silicone rubber layer can also be formed between the base material of the transfer belt and the fluorine-containing resin layer. The tension roller 6*c* is provided to rotate the transfer belt 6*a* while tightly stretching the transfer belt 6*a*.

The fixing device 7 includes a fixing roller having a heater such as halogen lamps therein and a pressure roller which is pressure-contacted with the fixing roller. The fixing roller has a metallic cylinder, an elastic layer (e.g., silicone rubber layers) having a thickness ranging from 100 to 500 μm (preferably about 400 μm), and an outermost resin layer including a releasing resin such as fluorine-containing resins. The outermost resin layer is typically formed using a resin tube such as tetrafluoroethylene/perfluoroalkylvinyl ether copolymer (PFA) tubes. The thickness of the outermost resin layer is preferably from 10 to 50 μm. A temperature detector is provided on the peripheral surface of the fixing roller to measure and control the surface temperature of the fixing roller within a range from about 160° C. to about 200° C.

The pressure roller includes a metallic cylinder and an offset preventing layer formed on the metallic cylinder. The offset preventing layer is typically made of a material such as tetrafluoroethylene/perfluoroalkylvinyl ether copolymers (PFA) and polytetrafluoroethylene (PTFE). Similar to the case of the fixing roller, an elastic layer can be formed between the metallic cylinder and the offset preventing layer.

The cleaning device 8 includes a first cleaning blade 8*a* and a second cleaning blade 8*b* which is located on the downstream side from the first cleaning blade 8*a* relative to the rotating direction of the photoreceptor 1. In addition, the cleaning device 8 also includes a collection member 8*d* to collect toner particles removed by cleaning, and a collection coil 8*c* to transport the collected toner particles to a container (not shown).

The first cleaning blade 8*a* is made of a material such as metals, resins and rubbers. Among these materials, rubbers such as fluorine-containing rubbers, silicone rubbers, butyl rubbers, butadiene rubbers, isoprene rubbers and urethane rubbers are preferably used. In particular, urethane rubbers are more preferably used. The first cleaning blade 8*a* mainly removes toner particles remaining on the surface of the photoreceptor 1 after the transferring process.

The second cleaning blade 8*b* mainly removes materials such as additives included in the toner, which adhere to the surface of the photoreceptor 1 forming a film. The second cleaning blade 8*b* can be made of the same material as that of the first cleaning blade 8*a*, but typically includes an abrasive component to effectively remove the film materials from the photoreceptor 1.

Turning the attention now to the charging device 2 of the present invention, the cleaner 2*b*, which cleans the surface of the charging roller 2, will be explained.

The cleaner 2*b* includes the cleaning roller 2*c* made of a foam resin as a cleaning member. The foam resin, for example, can be wound on a metallic cylinder. The foam resin used is preferably a non-cellular foam resin having a density ranging from 5 to 15 $kg/m^3$ and a tensile strength varying from 1.2 to 2.2 $kg/cm^2$.

Figure 4A:
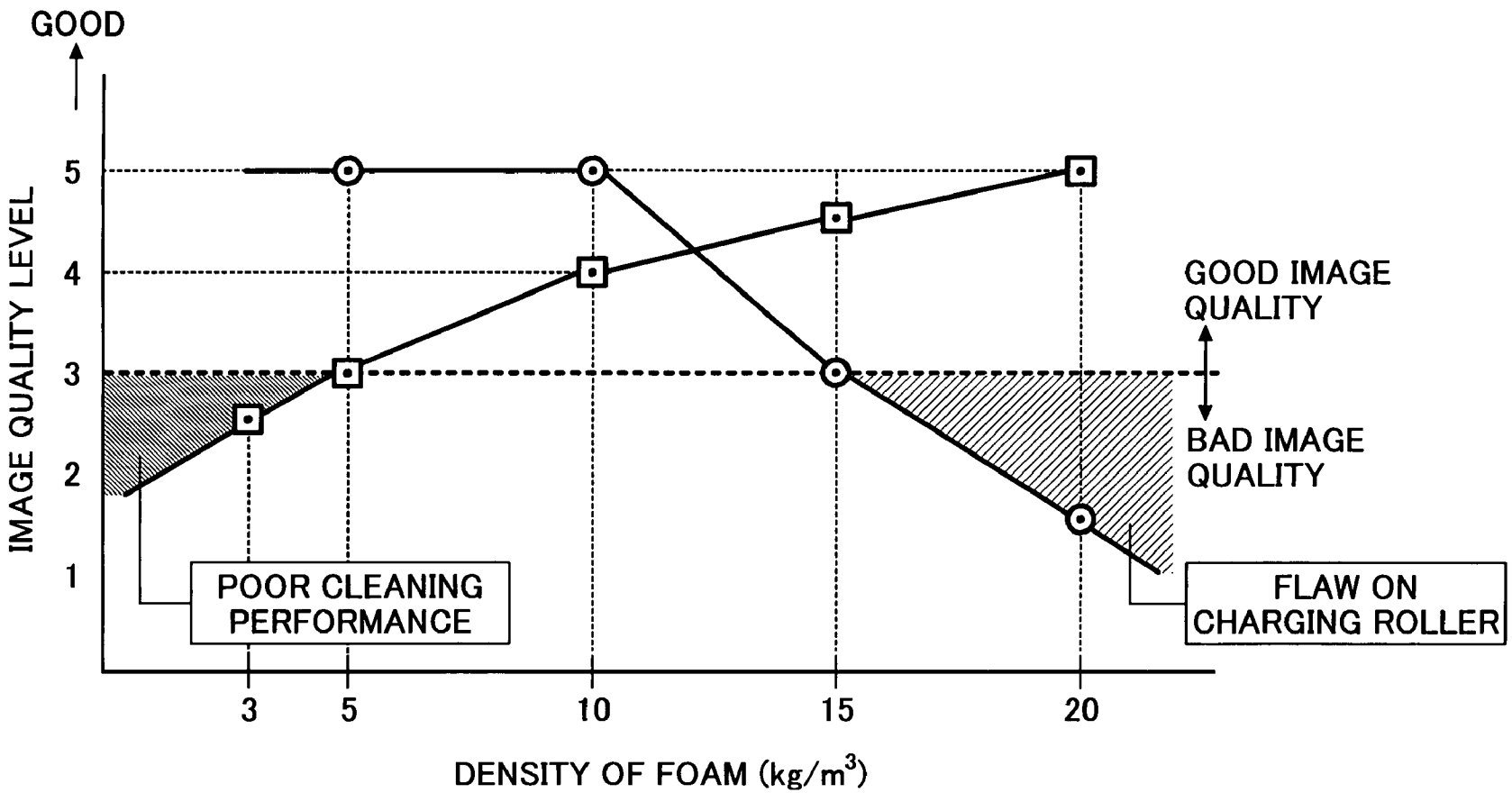
FIG. 4A is a graph illustrating the relationships between the density of a foam resin and the image quality level in terms of background fouling and streak.
Figure 4B:
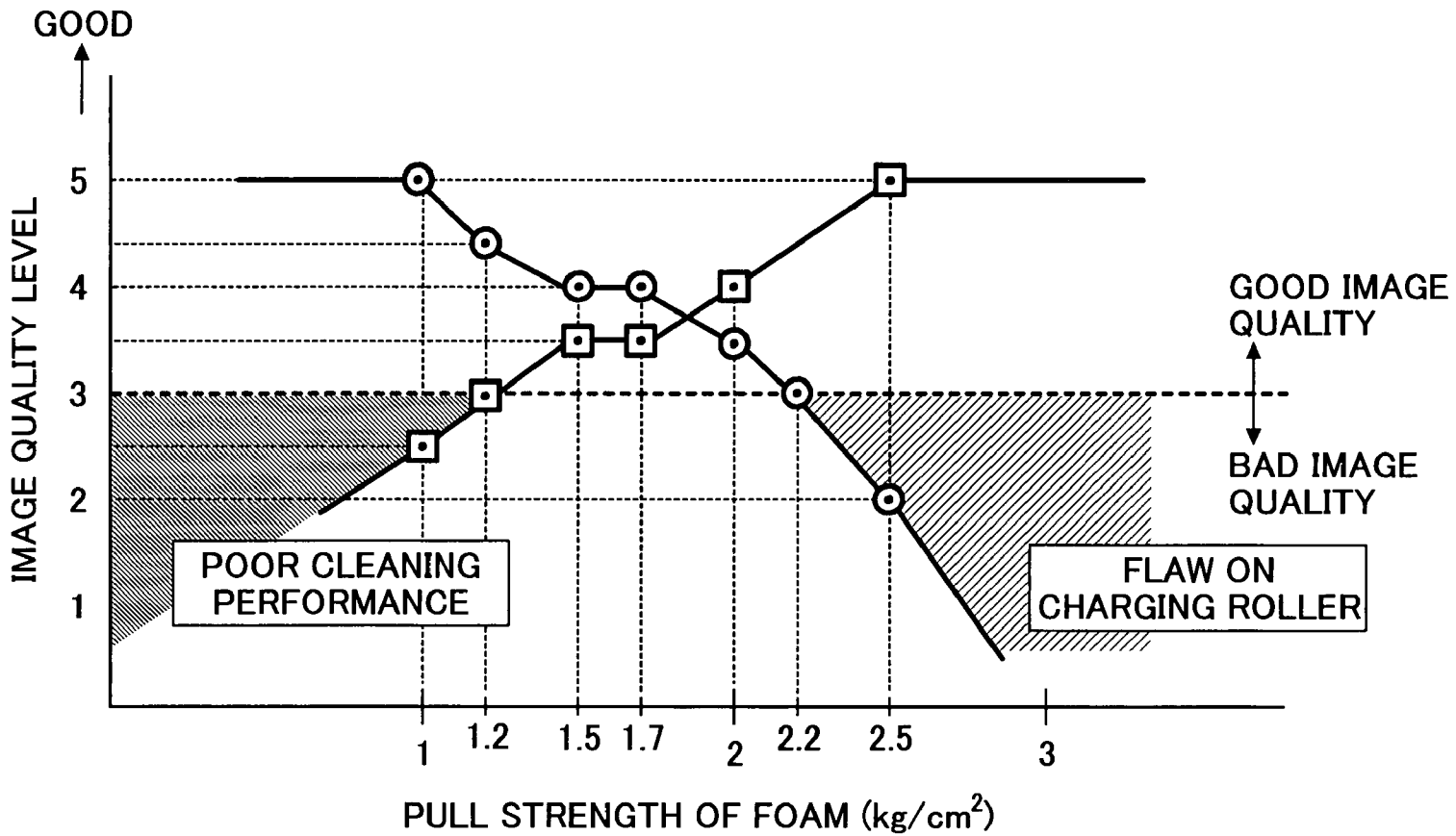
FIG. 4B is a graph illustrating the relationships between the tensile strength of the foam resin and the image quality level in terms of background fouling and streak.

FIGS. 4A and 4B are graphs illustrating the variation in image quality level as a function of the density and the tensile strength of the foam, respectively.

When the cleaning performance of the cleaning roller 2*c* is poor and dusts on the surface of the charging roller 2*a* are not removed, the photoconductor 1 is not charged well, resulting in background fouling. The square symbols plotted in FIGS. 4A and 4B represent the relationship between the density and the tensile strength of the foam, respectively, and image quality level in terms of background fouling. As the amount of background fouling decreases, the image quality level increases.

When abrasion between the cleaning roller 2*c* and the charging roller 2*a* causes scars on the surface of the charging roller 2*a*, images obtained have streaks. The circular symbols in FIGS. 4A and 4B represent the relationship between the density and the tensile strength of the foam, respectively, and image quality level in terms of streaks. As the amount of the streaks decreases, the image quality level becomes better. In FIGS. 4A and 4B, the highest image quality level is 5.0 and a practically acceptable image quality is not less than 3.0.

As seen on FIG. 4A, when the foam has a density equal to or greater than 5 kg/m$^3$, the cleaning performance of the cleaning roller 2*c* is acceptable. In contrast, when the density of the foam is too small, the cleaning performance becomes so poor that bad charging of the photoconductor 1 occurs at an early stage, resulting in images affected by background fouling. To the contrary, when the density of the foam is too large, the cleaning performance is good but significant damage to the surface of the charging roller 2*a* results due to the cleaning process. Therefore, scars made on the surface of the charging roller 2*a* at an early stage leads to undesirable image problems such as streaks.

In addition, as seen on FIG. 4B, when the foam has a tensile strength equal to or greater than 1.2 kg/cm$^2$, the cleaning performance of the cleaning roller 2*c* is adequate. When the tensile strength of the foam is too small, the foam strength is not enough and therefore the foam resin crumbles at an early stage, resulting in poor cleaning. In contrast, when the tensile strength of the foam is too large, the surface of the charging roller 2*a* is scarred at an early stage and resulting images have streaks regardless of the roller's cleaning ability.

Therefore, it is preferred that the foam resin in the cleaning roller 2*c* have a density ranging from 5 to 15 kg/M$^3$ and a tensile strength in the range of 1.2 to 2.2 kg/cm$^2$. The foam resin having a continuous foam structure and a density within the range mentioned above, has a mesh form with fine pores. The cleaning roller 2*c* can adequately remove extraneous matters such as toners from the surface of the charging roller 2*a*.

In addition, a foam resin having a tensile strength within the range mentioned above, may tend to crumble: therefore, a portion of the foam resin where the foam resin contacts with the charging roller 2*a* may fall off due to the frictional force therebetween. The extraneous matters such as toners contained in pores in the foam fall off together. That is, different from conventional foam resins, the foam resin does not store extraneous matters in its pores and has always a clean surface to clean the charging roller 2*a*. Consequently, the cleaning roller 2*c* performance remains good for a long period of time without scratching the surface of the charging roller 2*a*.

Among the foam resins having the properties mentioned above, a melamine foam resin is especially preferred. Foam resins made of melamine resin have hard mesh fibers and, therefore, can hook and remove extraneous matters on the surface of the charging roller 2*a*. Since melamine foam resins not only have this excellent cleaning ability but also exhibit the crumbling tendency mentioned above, a fresh face of the cleaning roller 2*c* always contacts the surface of the charging roller 2*a*. Therefore, an excellent cleaning ability is maintained for an extended period of time.

The cleaning roller 2*c* is rotatably supported and rotates interlockingly with the charging roller 2*a* in the direction shown by the arrow illustrated in FIG. 2. This means that, since the cleaning roller 2*c* is driven by the charging roller 2*a* and does not require a driving device, the structure can be simplified. In addition, since the cleaning roller 2*c* is made of the foam resin mentioned above, the need to generate a bias pressures to make the pressure to make the cleaning roller 2*c* contact with the surface of the charging roller 2*a* is not particularly necessary for an excellent cleaning performance. As a result, wearing of the surface of the charging roller 2*a* can be significantly reduced or eliminated.

Figure 7:
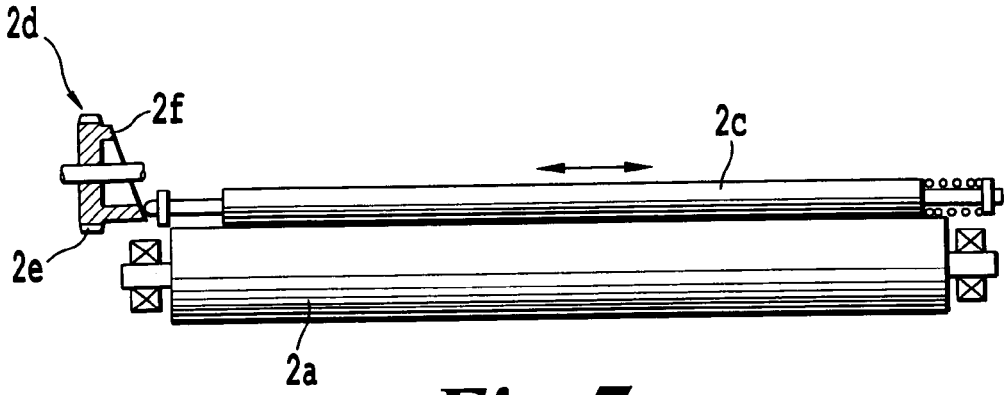
FIG. 7 illustrates an embodiment of the invention with an oscillating mechanism provided on a shaft of a cleaning roller.

In addition, as shown in FIG. 7, the cleaner 2*b* preferably has an oscillating mechanism 2*d* to oscillate the cleaning roller 2*c* along its longitudinal direction as the charging roller 2*a* rotates. For example, a bearing is provided on the shaft of the cleaning roller 2*c* so as to face the surface of an oscillating cam 2*f* of a gear 2*e*. When the charging roller 2*a* rotates, the gear with the oscillating cam is also rotated, thereby oscillating the cleaning roller 2*c* along its longitudinal direction.

By oscillating the cleaning roller 2*c*, the surface of the charging roller 2*a* can be uniformly cleaned particularly, paper dust typically generated from both edge portions of the receiving papers that adhere to edge portions of the photoreceptor 1. The paper dust is then transferred to the edge portions of the charging roller 2*a*. By oscillating the cleaning roller 2*c*, such paper dust can be easily removed from the charging roller 2*a*.

Figure 8:
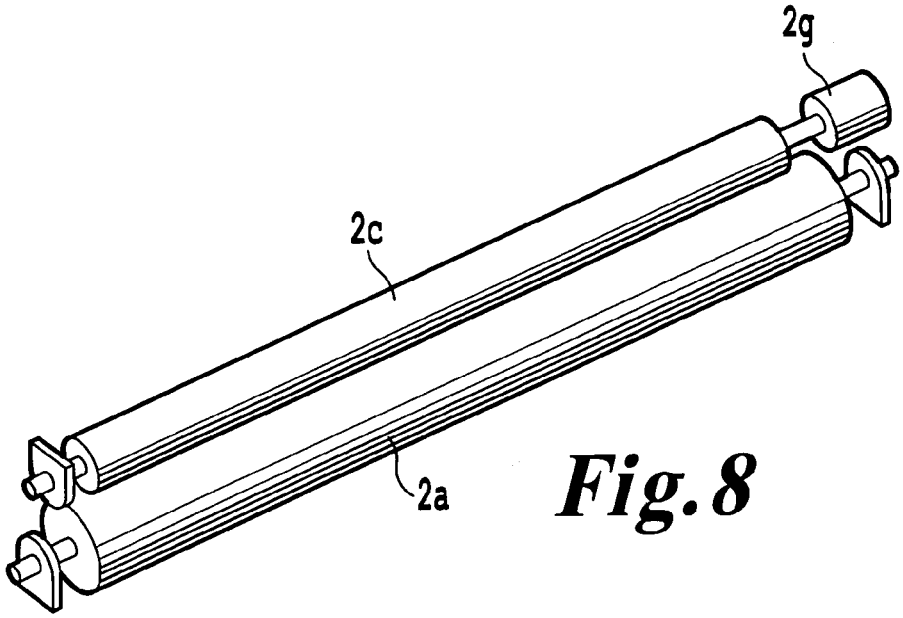
FIG. 8 illustrates another embodiment of the invention with a one-way clutch provided on a shaft of a cleaning roller.

Alternatively, as shown in FIG. 8 a one-way clutch 2*g* can be provided on the shaft of the cleaning roller 2*c*. During image forming operations, the one-way clutch is locked, i.e., the cleaning roller 2*c* does not rotate. Therefore, the charging roller 2*a* is cleaned by the rubbing action against the cleaning roller 2*c*, which is not in rotation. When image forming operations are completed, the photoreceptor 1 stops after reversely rotating slightly. At this point, the cleaning roller 2*c* also slightly rotates via the one-way clutch and then stops. By using such a mechanism, the charging roller 2*a* can avoid contacting the foam resin portion of the cleaning roller 2*c* under excessive pressure; therefore wearing of the charging roller 2*a* can be controlled. In addition, the portion of the face of the cleaning roller 2*c* in contact with the charging roller 2*a* is slightly changed, thereby assuring that cleaning can be performed well at any time.

The cleaner mentioned above for cleaning a charging roller can be used not only for an image forming apparatus but also for a process cartridge which is detachable from the image forming apparatus and which includes at least a photoreceptor and a charger, optionally together with one or more devices such as developing devices and photoreceptor-cleaning devices. Specifically, the cleaner mentioned above for cleaning a charging roller may also be provided on a charger of the process cartridge. The cleaner can clean the surface of the charging roller and maintain its cleaning ability until the life of the process cartridge comes to an end, thereby insuring that charging is performed well over a long period of time.

The image forming apparatus of the present invention having the charging device with the cleaner is not limited to the embodiment mentioned above. For example, an image forming apparatus including: an intermediate transfer medium bearing a toner image transferred from a photoreceptor to retransfer it to a receiving material; and/or a plurality of photoreceptors to produce multi-color images, and the like, is also included in the scope of the present invention.

The toner for use in the image forming apparatus of the present invention preferably has a volume average particle diameter (Dv) ranging from 3 to 8 μm, and a ratio (Dv/Dn) of the volume average particle diameter (Dv) to the number average particle diameter (Dn) preferably in the range from 1.00 to 1.40. Namely, a toner having a relatively small particle diameter and a narrow particle diameter distribution is preferably used. By using a toner having a small particle diameter, the toner can be densely adhered to a latent electrostatic image without protruding from the latent image, thereby producing an image with high density and high quality image. By using a toner having a narrow particle diameter distribution, the toner charge distribution can be more uniformed, thereby resulting in an image with high quality and without background development. In addition, the transferability of the toner can also be improved, thus the quantity of the toner particles remaining on the photoreceptor can be reduced, thereby extending the life of the charging roller cleaner.

Figure 5A:
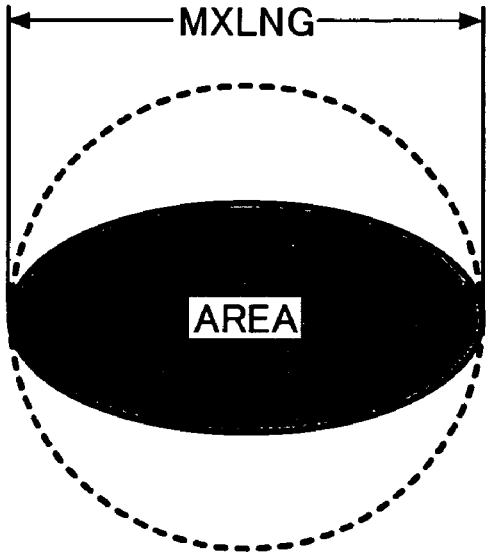
FIGS. 5A and 5B are projected images of toner particles for explaining the form factors SF-1 and SF-2.

The toner for use in the image forming apparatus of the present invention preferably has a spherical form such that form factors SF-1 and SF-2 of the toner fall in the specific ranges mentioned below. FIGS. 5A are 5B are schematic views for illustrating the form factors SF-1 and SF-2.

As illustrated in FIG. 5A, the form factor SF-1 represents the degree of roundness of a toner particle and is defined by the following equation (1):

$$SF\text{-}1=\{(MXLNG)^2/(\text{AREA})\}\times(100\pi/4) \quad (1)$$

where MXLNG represents a diameter of the circle circumscribing the image of a toner particle obtained, for example, by observing the toner particle with a microscope, and AREA represents the area of the image.

When the SF-1 is 100, the toner particle has a true spherical form. It can be said that as SF-1 increases, the toner form differs much from a true spherical form.

Figure 5B:
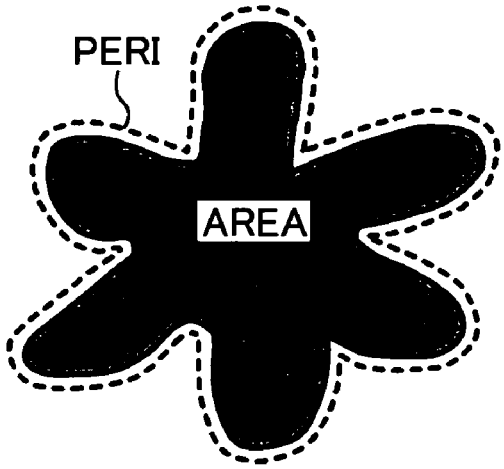

As illustrated in FIG. 5B, the form factor SF-2 represents the degree of concavity and convexity of a toner particle and is defined by the following equation (2):

$$SF\text{-}2=\{(PERI)^2/(\text{AREA})\}\times(100/4\pi) \quad (2)$$

where PERI represents the peripheral length, or perimeter, of the image of a toner particle observed, for example, by a microscope; and AREA represents the area of the image.

When the SF-2 is 100, the surface of the toner particle does not have any concavity or convexity. It can be said that as SF-2 increases, the toner surface becomes rough.

The form factors SF-1 and SF-2 are determined by the following method:

(1) a photograph of particles of a toner is taken using a scanning electron microscope (S-800, manufactured by Hitachi Ltd.); and (2) particle images of 100 toner particles are analyzed using an image analyzer (LUSEX 3 manufactured by Nireco Corp.).

The toner for use in the image forming apparatus preferably has a form factor SF-1 greater than 100 and not greater than 180 and a form factor SF-2 greater than 100 and not greater than 180. When the toner has particles that are nearly spherical, the contact area between toner particles decreases, resulting in a decrease of adhesion between toner particles, thereby resulting in a toner having good fluidity. In addition, the contact area of a toner particle with the photoreceptor also decreases, resulting in decreases of adhesion of the toner particle to the photoreceptor, thereby improving toner transferability. On the other hand, a spherical toner having form factors SF-1 and SF-2 of 100 tends to reach into the gap between the first cleaning blade 8*a* and the photoreceptor 1, thus the toner preferably has form factors SF-1 and SF-2 greater than 100. When the form factors SF-1 and SF-2 are too large, toner particles tend to scatter around the toner images, resulting in deterioration of image quality. Therefore, it is preferred that the form factors SF-1 and SF-2 do not exceed 180.

The toner for use in the image forming apparatus of the present invention is preferably prepared by the following method:

(1) toner constituents including at least a polyester prepolymer having a functional group having a nitrogen atom, another polyester resin, a colorant and a release agent are dissolved or dispersed in an organic solvent to prepare a toner constituent liquid; and (2) the toner constituent liquid is dispersed in an aqueous medium including a compound which can be reacted with the polyester prepolymer to crosslink and/or elongate the polyester prepolymer and to prepare toner particles.

Toner constituents and toner manufacturing method will be described in detail.

Modified Polyester Resin

The toner of the present invention includes a modified polyester resin (i) as a binder resin. The modified polyester resin (i) is preferably prepared by crosslinking and/or elongating a polyester prepolymer having a functional group having a nitrogen atom with a compound such as amines. The modified polyester resin (i) is a polyester resin having a group other than the ester group; or a polyester resin in which a resin component other than the polyester resin is bonded with the polyester resin through a covalent bonding or an ionic bonding. Specifically the modified polyester resin may be polyester resins which are prepared by incorporating a functional group such as an isocyanate group, which can be reacted with a carboxyl group or a hydroxyl group, in the end portion of a polyester resin and reacting the polyester resin with a compound having an active hydrogen atom.

Suitable modified polyester resins for use as the modified polyester resin (i) include reaction products of a polyester prepolymer (A) having an isocyanate group with an amine (B). As the polyester prepolymer (A) having an isocyanate group, for example, polyesters prepared by a method in which a polycondensation product of a polyol (PO) and a polycarboxylic acid (PC) which has a group having an active hydrogen is reacted with a polyisocyanate (PIC) can be used.

Suitable groups having an active hydrogen include a hydroxyl group (an alcoholic hydroxyl group and a phenolic hydroxyl group), an amino group, a carboxyl group, a mercapto group, etc. Among these groups, alcoholic hydroxyl groups are preferred.

Suitable preferred polyols (PO) include diols (DIO) and polyols (TO) having three or more hydroxyl groups. It is preferable to use diols (DIO) alone or mixtures in which a small amount of a polyol (TO) is added to a diol (DIO).

Specific examples of the diols (DIO) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (PC) include dicarboxylic acids (DIC) and polycarboxylic acids (TC) having three or more carboxyl groups. It is preferable to use dicarboxylic acids (DIC) alone or mixtures in which a small amount of a polycarboxylic acid (TC) is added to a dicarboxylic acid (DIC).

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

As the polycarboxylic acid (PC), anhydrides or lower alkyl esters (e.g., methyl esters, ethyl esters or isopropyl esters) of the polycarboxylic acids mentioned above can be used for the reaction with a polyol (PO).

Suitable mixing ratio (i.e., an equivalence ratio [OH]/[COOH]) of a polyol (PO) to a polycarboxylic acid (PC) ranges from 2/1 to 1/1, preferably from 1.5/1 to 1/1 and more preferably from 1.3/1 to 1.02/1.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane dilsocyanate); aromatic aliphatic diisocyanates (e.g., $\alpha,\alpha,\alpha',\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (PIC) to a polyester having a hydroxyl group varies from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, thereby deteriorating the hot-offset resistance of the toner.

The content of the constitutional component of a polyisocyanate (PIC) in the polyester prepolymer (A) having an isocyanate group at its end portion ranges from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is too small (less than 1 per 1 molecule) the molecular weight of the resultant urea-modified polyester decreases and thereby the hot offset resistance deteriorates.

Specific examples of the amines (B), which are to be reacted with a polyester prepolymer (A), include diamines (B1), polyamines (B2) having three or more amino groups, amino alcohols (B3), amino mercaptans (B4), amino acids (B5), and blocked amines (B6) in which the amines (B1–B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1–B5 mentioned above with a ketone such as acetone, methyl ethyl ketone and methyl isobutyl ketone; oxazoline compounds, etc. Among these compounds, diamines (B1) and mixtures in which a diamine (B1) is mixed with a small amount of a polyamine (B2) are preferable.

The mixing ratio (i.e., a ratio ([NCO]/[NHx]) of the content of the prepolymer (A) having an isocyanate group to the amine (B) ranges from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The modified polyesters may include a urethane linkage as well as a urea linkage. The molar ratio (urea/urethane) of the urea linkage to the urethane linkage may vary from 100/0 to 10/90, preferably from 80/20 to 20/80 and more preferably from 60/40 to 30/70. When the content of the urea linkage is too low, the hot offset resistance of the resultant toner deteriorates.

The modified polyesters (i) can be prepared in different ways, including, for example, one-shot methods or prepolymer methods. The weight average molecular weight of the modified polyesters (i) is not less than 10,000, preferably from 20,000 to 10,000,000 and more preferably from 30,000 to 1,000,000. When the weight average molecular weight is too low, the hot offset resistance of the resultant toner deteriorates. The number average molecular weight of the modified polyesters is not particularly limited (i.e., the weight average molecular weight should be primarily controlled so as to be in the range mentioned above) when a polyester resin (ii) which is not modified is used in combination. Namely, controlling of the weight average molecular weight of the modified polyester resins has priority over controlling its number average molecular weight. However, when a modified polyester is used alone, the number average molecular weight is from 1,000 to 10,000, preferably from 2,000 to 8,000, and more preferably from 2,000 to 5,000. When the number average molecular weight is too high, the low temperature fixability of the resultant toner deteriorates, and in addition the gloss of full color images decreases when the toner is used for color toners.

In the crosslinking reaction and/or elongation reaction of a polyester prepolymer (A) with an amine (B) to prepare a modified polyester (i), a reaction inhibitor can be used if desired to control the molecular weight of the resultant modified polyester. Specific examples of such a reaction inhibitor include monoamines (e.g., diethyle amine, dibutyl amine, butyl amine and lauryl amine), and blocked amines (i.e., ketimine compounds) prepared by blocking the monoamines mentioned above.

Unmodified Polyester

The toner for use in the image forming apparatus of the present invention includes not only the modified polyester resins (i) mentioned above, but also an unmodified polyester (ii) serving as a binder resin of the toner. By using a combination of a modified polyester (i) with an unmodified polyester (ii), the low temperature fixability of the toner can be improved and in addition the toner can produce color images having high gloss.

Suitable unmodified polyesters (ii) include polycondensation products of a polyol (PO) with a polycarboxylic acid (PC). Specific examples of the polyol (PO) and the polycarboxylic acid (PC) are mentioned above for use in the modified polyester (i). In addition, specific examples of the suitable polyol (PO) and polycarboxylic acid (PC) are also mentioned above.

Furthermore, as the unmodified polyester (ii), polyester resins modified by a linkage (such as urethane linkage) other than a urea linkage, can also be used as well as unmodified polyester resins.

When a mixture of a modified polyester (i) with an unmodified polyester (ii) is used as the binder resin, it is preferable that the modified polyester (i) at least partially mixes with the unmodified polyester (ii) to improve the low temperature fixability and hot offset resistance of the resultant toner. Namely, it is preferred that the modified polyester (i) have a structure similar to that of the unmodified polyester (ii). The mixing ratio (i/ii) of a modified polyester (i) to an unmodified polyester (ii) varies from 5/95 to 80/20, preferably from 5/95 to 30/70, more preferably from 5/95 to 25/75, and even more preferably from 7/93 to 20/80. When the added amount of modified polyester (i) is too small, the hot offset resistance of the resultant toner deteriorates and, in addition, it is hard to impart a good combination of high temperature preservability and low temperature fixability to the resultant toner.

The peak molecular weight of the unmodified polyester (ii) for use in the toner of the present invention is from 1,000 to 10,000, preferably from 2,000 to 8,000, and more preferably from 2,000 to 5,000. When the peak molecular weight is too low, the high temperature preservability of the toner deteriorates. In contrast, when the peak molecular weight is too high, the low temperature fixability of the toner deteriorates.

It is preferable for the unmodified polyester (ii) to have a hydroxyl value not less than 5 mgKOH/g, preferably from 10 to 120 mgKOH/g, and more preferably from 20 to 80 mgKOH/g. When the hydroxyl value is too low, it is hard to impart a good combination of high temperature preservability and low temperature fixability to the resultant toner.

The unmodified polyester (ii) preferably has an acid value of from 1 to 5 mgKOH/g, and more preferably from 2 to 4 mgKOH/g. In particular, when a wax having a high acid value is used for the toner as a release agent, the binder resin preferably has a low acid value to impart good charging ability and a high resistivity to the resultant toner.

In the toner of the present invention, the binder resin (i.e., the modified polyester and the unmodified polyester) preferably has a glass transition temperature (Tg) between 35 and 70° C., and preferably between 55 and 65° C. When the glass transition temperature is too low, the high temperature preservability of the toner deteriorates. In contrast, when the glass transition temperature is too high, the low temperature fixability of the toner deteriorates. Since a modified polyester resin is used as the binder resin, the resultant toner has better high temperature preservability than conventional toners including a polyester resin as a binder resin even if the modified polyester resin has a relatively low glass transition temperature.

Colorant

The toner of the present invention includes a colorant.

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight, based on total weight of the toner.

Master batch pigments, which are prepared by combining a colorant with a resin, can be used as the colorant of the toner for use in the image forming apparatus of the present invention. Specific examples of the resin for use in the master batch pigments or for use in combination with master batch pigments include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins can be used alone or in combination.

Charge Controlling Agent

The toner for use in the image forming apparatus of the present invention includes a charge controlling agent.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts) alkylamides, phosphor and compounds including phosphor, tungsten and compounds including tungsten, fluorine-containing activators, metal salts of salicylic acid, salicylic acid derivatives, etc.

Specific examples of the marketed products of the charge controlling agents include BONTRON® 03 (Nigrosine dyes), BONTRON® P-51 (quaternary ammonium salt), BONTRON® S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® (triphenyl methane derivative), COPY CHARGE® NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the amount of toner charge is too large, thus the developing roller electrostatic force attracting the toner increases, resulting in a deterioration of fluidity and a decrease of toner image density.

Release Agent

The toner for use in the image forming apparatus of the present invention includes a release agent, or wax. Suitable release agents include waxes having a melting point of from 50 to 120° C. When such a wax is included in the toner, the wax is dispersed in the binder resin and serves as a release agent at a location between a fixing roller and the toner particles. Thereby hot offset resistance can be improved without applying an oil to the fixing roller used.

In the present invention, the melting point of the release agents is measured by a differential scanning calorimeter (DSC). The maximum absorption peak is defined as the melting point.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. Further, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

Charge controlling agents and release agents can be kneaded with a masterbatch and a binder resin. In addition, the charge controlling agents and release agent can be added to an organic solvent when the toner constituent liquid is prepared.

External Additive

The thus prepared toner particles (i.e., the mother toner) may be mixed with an external additive to assist in improving the fluidity, developing property and charging ability of the toner particles. Suitable external additives include particulate inorganic materials. It is preferable for the particulate inorganic materials to have a primary particle diameter between 5 nm and 2 μm, and more preferably between 5 nm and 500 nm. In addition, it is preferable that the specific surface area of such particulate inorganic materials measured by a BET method be from 20 to 500 $m^2/g$. The content of the external additive is preferably from 0.01 to 5% by weight, and more preferably from 0.01 to 2.0% by weight, based on total weight of the toner composition.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesiumoxide, zirconiumoxide, barium sulfate, barium carbonate, calcium carbonate, silicon carbide, silicon nitride, etc.

Among these particulate inorganic materials, a combination of a hydrophobic silica and a hydrophobic titanium oxide is preferably used. In particular, when a hydrophobic silica and a hydrophobic titanium oxide each having an average particle diameter not greater than 50 nm are used as an external additive, the electrostatic force and van der Waals' force between the external additive and the toner particles are improved, resulting in the resultant toner having the proper charge quantity. In addition, even when the toner is agitated in a developing device, the external additive is hardly released from the toner particles, and, as a result, image defects such as white spots and image omissions are hardly produced. Further, the quantity of particles of the toner remaining on image bearing members can be reduced.

When particulate titanium oxides are used as an external additive, the resultant toner can stably produce toner images having a proper image density even when environmental conditions are changed. However, the charge rising properties of the resultant toner composition tend to deteriorate particularly when the addition amount of the particulate titanium oxide is greater than that of the particulate silica. However, when the content of the hydrophobic silica and hydrophobic titanium oxide is from 0.3 to 1.5% by weight based on the weight of the toner particles, the charge rising properties of the toner do not deteriorate. Namely, good images can be produced by the toner even after long repeated use.

Now, the method for manufacturing the toner for use in the present invention will be explained. However, the manufacturing method is not limited to example presented herein below.

(1) First, toner constituents including a colorant, an unmodified polyester resin, a polyester prepolymer having an isocyanate group, and a release agent are dissolved or dispersed in an organic solvent to prepare a toner constituent liquid.

Suitable organic solvents include organic solvents having a boiling point less than 100° C. so that the solvent can be easily removed from the resultant toner particle dispersion.

Specific examples of the organic solvents include toluene, xylene, benzene, carbon tetrachloride, methylene chloride, 1,2-dichloroethane, 1,1,2-trichloroethane, chloroform, monochlorobenzene, dichloroethylidene, methyl acetate, ethyl acetate, methyl ethyl ketone, methyl isobutyl ketone, etc. These can be used alone or in combination. In particular, aromatic solvents such as toluene and xylene, and halogenated hydrocarbons such as 1,2-dichloroethane, chloroform and carbon tetrachloride are preferably used.

The addition quantity of the organic solvent is from 0 to 300 parts by weight, preferably from 0 to 100 parts by weight and more preferably from 25 to 70 parts by weight, per 100 parts by weight of the polyester prepolymer used.

(2) Next, the toner constituent liquid is emulsified in an aqueous medium in the presence of a surfactant and a particulate resin.

Suitable aqueous media include water, and mixtures of water with alcohols (such as methanol, isopropanol and ethylene glycol), dimethylformamide, tetrahydrofuran, cellosolves (such as methyl cellosolve) and lower ketones (such as acetone and methyl ethyl ketone).

The mixing ratio (A/T) of the aqueous medium (A) to the toner constituent liquid (T) is from 50/100 to 2000/100 by weight, and preferably from 100/100 to 1000/100 by weight. When the content of the aqueous medium is too low, the toner constituent liquid cannot be well dispersed, and thereby toner particles having a desired particle diameter cannot be produced. In contrast, when the content of the aqueous medium is too high, the manufacturing cost of the toner increases.

When the toner constituent liquid is dispersed in an aqueous medium, a dispersant can be preferably used to prepare a stable dispersion.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a surfactant having a fluoroalkyl group, a good dispersion can be prepared even when a small amount of the surfactant is used. Specific examples of the anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6–C11)oxy}-1-alkyl (C3–C4)sulfonate, sodium 3-{omega-fluoroalkanoyl (C6–C8)-N-ethylamino}-1-propanesulfonate, fluoroalkyl (C11–C20) carboxylic acids and their metal salts, perfluoroalkylcarboxylic acids and their metal salts, perfluoroalkyl(C4–C12)sulfonate and their metal salts, perfluorooctanesulfonic acid diethanol amides, N-propyl-N-(2-hydroxyethyl)perfluorooctanesulfone amide, perfluoroalkyl (C6–C10)sulfoneamidepropyltrimethylammonium salts, salts of perfluoroalkyl(C6–C10)-N-ethylsulfonyl glycin, monoperfluoroalkyl(C6–C16)ethylphosphates, etc.

Specific examples of the marketed products of such surfactants having a fluoroalkyl group include SURFLON® S-111, S-112 and S-113, which are manufactured by Asahi Glass Co., Ltd.; FRORARD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group include primary, secondary and tertiary aliphatic amino acids, aliphatic quaternary ammonium salts (such as perfluoroalkyl(C6–C10)sulfoneamidepropyltrimethylammonium salts), benzalkonium salts, benzetonium chloride, pyridiniumsalts, imidazoliniumsalts, etc., all of which have a fluoroalkyl group Specific examples of commercially available products of these elements include SURFLON® S-121 (from Asahi Glass Co., Ltd.); FRORARD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Any particulate polymers, whether they are thermoplastic resins or thermo-curing resins, can be also used as long as the toner constituents can form an aqueous dispersant. Specific preferred examples of such particulate polymers include vinyl resins, polyurethane resins, epoxy resins, polyester resins, polyamide resins, polyimide resins, silicone resins, phenol resins, melamine resins, urea resins, aniline resins, ionomer resins, and polycarbonate resins. The resins mentioned above can be used in combination.

Among the resins mentioned above, considering easiness of obtaining an aqueous dispersant of a particulate polymer having a fine spherical form, vinyl resins, polyurethane resins, epoxy resins, polyester resins and their combinational use are preferred. Specific preferred examples of such vinyl resins include homopolymers or copolymers of a vinyl monomer. Specific examples of such homopolymers and copolymers include styrene-(meta)acrylic ester copolymers, styrene butadiene copolymers, (meta) acrylic acid-acrylic ester copolymers, styrene-acrylic nitride copolymers, styrene-anhydride maleic acid copolymers, styrene-(meta) acrylic copolymers. The average particle diameter of the particulate polymer is from 5 to 300 nm and preferably from 20 to 200 nm.

In addition, an inorganic dispersant can be added to the aqueous medium. Specific examples of the inorganic dispersants include tricalcium phosphate, calcium carbonate, titanium oxide, colloidal silica, hydroxyapatite, etc.

Further, it is possible to stably disperse toner constituents in an aqueous medium using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds such as methyl cellulose, hydroxyethyl cellulose and hydroxypropyl cellulose, can also be used as the polymeric protective colloid.

The dispersion method is not particularly limited, and low speed shearing methods, high speed shearing methods, friction methods, high pressure jet methods, ultrasonic methods, etc. can be used. Among these methods, high speed shearing methods are preferable because particles having a particle diameter of from 2 μm to 20 μm can be easily prepared. At this point, the particle diameter (2 to 20 μm) means a particle diameter of particles including a liquid.

When a high speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C.

(3) At the same time when a toner constituent is dispersed in an aqueous medium, an amine (B) is added to the aqueous medium to be reacted with the polyester prepolymer (A) having an isocyanate group.

This reaction accompanies crosslinking and/or elongation of the molecular chains of the polyester prepolymer (A). The reaction time is determined depending on the reactivity of the amine (B) with the polyester prepolymer used, but is typically from 10 minutes to 40 hours, and preferably from 2 to 24 hours. The reaction temperature is from 0 to 150° C., and preferably from 40 to 98° C. In addition, known catalysts such as dibutyltin laurate and dioctyltin laurate, can be used for the reaction, if desired.

(4) After the reaction, the organic solvent is removed from the resultant dispersion (emulsion, or reaction product), and then the solid components are washed and then dried. Thus, a mother toner is prepared.

In order to remove the organic solvent, all the system is gradually heated while agitated under laminar flow conditions. Then the system is strongly agitated in a certain temperature range, followed by solvent removal, to prepare a mother toner having a spindle form.

In this case, when compounds such as calcium phosphate which are soluble in an acid or alkali are used as a dispersion stabilizer, it is preferable to dissolve the compounds by adding an acid such as hydrochloric acid, followed by washing of the resultant particles with water to remove calcium phosphate therefrom. In addition, calcium phosphate can be removed using a zymolytic method.

(5) Subsequently, a charge controlling agent is fixedly adhered to the mother toner. In addition, an external additive such as combinations of a particulate silica and a particulate titanium oxide, is adhered to the mother toner to prepare the toner of the present invention.

Addition of the charge controlling agent and the external additive to the mother toner can be made using a known method using a mixer or the like.

By using this manufacturing method, the resultant toner can have a relatively small particle diameter and a narrow particle diameter distribution. By controlling the strong agitation during the solvent removing process, the shape of the toner can be controlled so as to be of a desired form, i.e., a form between a rugby ball and a true sphere form. In addition, the surface characteristics of the toner can also be controlled to produce a surface having a desired roughness, i.e., a surface that is not too smooth or too rough.

The toner for use in the image forming apparatus of the present invention has substantially a spherical form satisfying the following relationships:

$$0.5 \leqq r2/r1 \leqq 1.0; \text{ and}$$

$$0.7 \leqq r3/r2 \leqq 1.0,$$

where r1 represents a major-axis diameter of the toner, r2 represents a minor-axis diameter, and r3 represents a thickness of the toner, wherein r3≦r2≦r1.

Figure 6A:
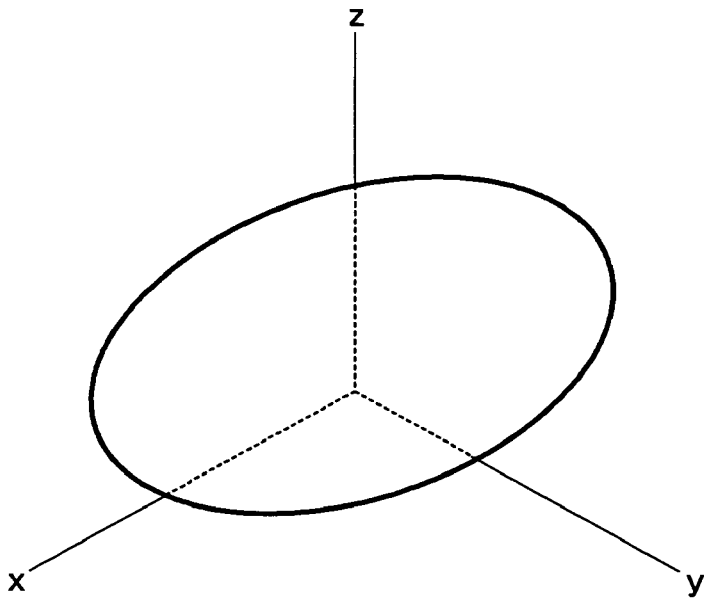
FIGS. 6A to 6C are schematic views of a toner particle for explaining the major axis particle diameter, the minor axis particle diameter and the thickness of the toner particle.
Figure 6B:
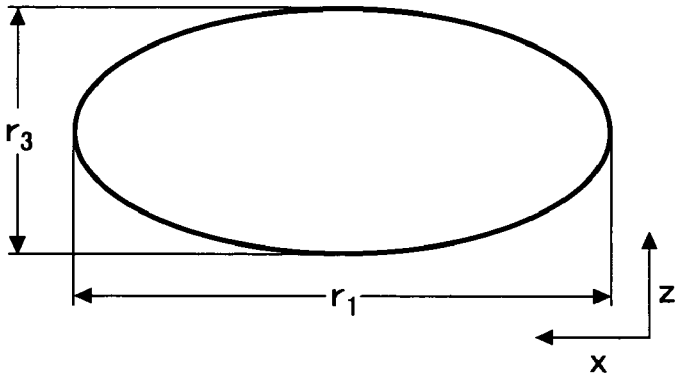
Figure 6C:
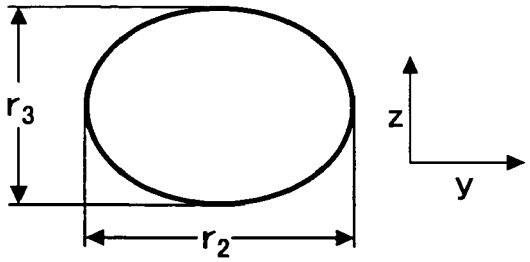

FIGS. 6A to 6C are schematic views illustrating a typical toner particle of the toner for use in the present invention. When the major-axis diameter of the toner is represented by r1, the minor-axis diameter of the toner is represented by r2 and the thickness of the toner is represented by r3, the ratio (r2/r1) is preferably from 0.5 to 1.0 and the ratio (r3/r2) is preferably from 0.7 to 1.0.

When the ratio (r2/r1) is too small (i.e., the particle form of the toner is not that of a true sphere) dot reproducibility and toner transferability deteriorate, thereby preventing high quality images to be produced. In addition, when the ratio (r3/r2) is too small, toner transferability deteriorates because the toner has a flat form. In particular, it is preferable that the ratio (r3/r2) be 1.0, because the toner can be rotated around its major axis more easily, resulting in good toner fluidity.

Toner particle diameters r1, r2 and r3 are determined by observing 100 particles with a scanning electron microscope while the viewing angle is changed.

The thus prepared toner can be used as a magnetic or non-magnetic one-component developer including no magnetic carrier.

When the toner is used for a two-component developer, the toner is mixed with a magnetic carrier. Suitable magnetic carriers include ferrite and magnetite including a divalent metal atom such as Fe, Mn, Zn and Cu. The volume average particle diameter of the carrier is preferably from 20 to 100 μm. When the particle diameter is too small, the problem that the carrier tends to adhere to the photoreceptor during the developing process occurs. In contrast, when the particle diameter is too large, the carrier is not mixed well with the toner, resulting in a toner that is insufficiently charged, consequently resulting in the formation of undesired images, such as images with background development.

Among the carrier materials mentioned above, Cu-ferrite including Zn is preferable because it has a high saturation magnetization. However, the carrier is not limited to this example, and a proper carrier may be selected depending on the developing device of the image forming apparatus of the present invention.

The surface of the carrier may also be coated with a resin such as silicone resins, styrene-acrylic resins, fluorine-containing resins and olefin resins. Such a resin is typically coated on a carrier by the following method:

(1) dissolving a coating resin in a solvent to prepare a coating liquid; and (2) coating the coating liquid on carrier particles, for example, by a spraying method using a fluidized bed.

Alternatively, the resin can also be coated by the following method:

(1) electrostatically adhering a resin to the surface of carrier particles; and (2) heating the resin and fixing it to the surface of the carrier particles.

The thickness of the thus formed resin layer on the carrier particles is from 0.05 to 10 μm, and preferably from 0.3 to 4 μm.

Having now fully described the invention, it will be apparent to one of ordinary skill in the art that many changes and modifications can be made thereto without departing from the spirit and scope of the invention as set forth herein.

What is claimed as new and desired to be secured by Letters Patent of the United States is:

1. A charging device comprising:

a charging roller comprising a metallic cylinder having an elastic layer disposed thereon; and a cleaner configured to clean a surface of the charging roller, the cleaner comprising:

a driving shaft; and a cleaning roller rotatably mounted on the driving shaft, the cleaning roller being made of a non-cellular foam resin having a tensile strength of from 1.2 to 2.2 kg/cm2.

2. The charging device according to claim 1, wherein a density of said foam resin varies approximately between 5 to 15 kg/m3.

3. The charging device according to claim 1, wherein the foam resin has an expansion rate of from 20 to 40%.

4. The charging device according to claim 1, wherein the cleaning roller is made of a melamine foam resin.

5. The charging device according to claim 1, wherein the cleaning roller is rotatably contacted with the charging roller such that the cleaning roller is rotated interlockingly while being driven by the charging roller.

6. The charging device according to claim 1, wherein the cleaning roller further comprises an oscillating unit configured to oscillate the cleaning roller along a longitudinal direction thereof.

7. The charging device according to claim 1, wherein the cleaner further comprises a one-way clutch provided on the driving shaft of the cleaning roller.

8. A process cartridge comprising:

an image bearing member on which a latent image is formed; and the charging device of claim 1 configured to uniformly charge a surface of the image bearing member.

9. The process cartridge according to claim 8, wherein a density of said foam resin varies approximately between 5 to 15 kg/m3.

10. The image forming apparatus according to claim 9, wherein a density of said foam resin varies approximately between 5 to 15 kg/m3.

11. The image forming apparatus according to claim 9, wherein a toner has a volume average particle diameter (Dv) of from 3 to 8 μm, and a ratio Dv/Dn varies from 1.00 to 1.40, where Dn is a number average particle diameter.

12. The image forming apparatus according to claim 9, wherein each of form factors SF-1 and SF-2 of a toner is greater than 100 and not greater than 180.

13. An image forming apparatus comprising:

an image bearing member;

the charging device of claim 1 configured to uniformly charge the image bearing member;

a light irradiator configured to irradiate a surface of the charged image bearing member with light to form a latent electrostatic image on the image bearing member;

a developing device configured to develop the latent electrostatic image with a developer including a toner to form a toner image on the image bearing member;

a transferring device configured to transfer the toner image onto a receiving material; and a fixing device configured to fix the toner image on the receiving material.

14. The image forming apparatus according to claim 13, wherein the toner satisfies the following relationships:

$$0.5 \leqq r2/r1 \leqq 1.0; \text{ and}$$

$$0.7 \leqq r3/r2 \leqq 1.0,$$

wherein r1 represents a major-axis particle diameter of the toner, r2 represents a minor-axis diameter of the toner and r3 represents a thickness of the toner, and wherein r3≦r2≦r1.

15. A cleaner for cleaning a surface of a charging roller, comprising:

a roller having a driving shaft; and a cleaning roller rotatably mounted on the driving shaft, and made of a non-cellular foam resin having a tensile strength ranging from 1.2 to 2.2 kg/cm2.

16. The cleaner according to claim 15, wherein a density of said foam resin varies approximately between 5 to 15 kg/m3.

17. The image forming apparatus according to claim 16, wherein a toner is prepared by a method comprising:

dispersing or dissolving toner constituents comprising a polyester prepolymer having a functional group having a nitrogen atom, a polyester resin, a colorant, and a release agent in an organic solvent to prepare a toner constituent liquid; and dispersing the toner constituent liquid in an aqueous medium having a compound capable of reacting the functional group of the polyester prepolymer to perform at least one of a crosslinking reaction and an elongation reaction of the polyester prepolymer and to form toner particles in the aqueous medium.

* * * * *